US006813785B1

(12) United States Patent
Baker

(10) Patent No.: US 6,813,785 B1
(45) Date of Patent: Nov. 9, 2004

(54) PLUNGER CONTAINER

(76) Inventor: William N. Baker, 2014 Esquire Dr., Anchorage, AK (US) 99517

( * ) Notice: Subject to any disclaimer, the term of this patent is extended or adjusted under 35 U.S.C. 154(b) by 0 days.

(21) Appl. No.: 10/408,526

(22) Filed: Apr. 7, 2003

(51) Int. Cl.[7] ..... E03D 11/00
(52) U.S. Cl. ..... 4/255.11; 4/255.05; 4/255.01
(58) Field of Search ..... 220/844, 848, 220/4.22, 4.21, 366.1, 367.1; 4/255.01, 255.05, 255.11, 300.3; 206/349, 15.2; D6/524, 551

(56) References Cited

U.S. PATENT DOCUMENTS 4,458,368 A * 7/1984 Webb ..... 4/255.11
5,335,374 A * 8/1994 Wilk et al. ..... 4/255.11
5,706,528 A * 1/1998 Broback ..... 4/253
5,924,566 A * 7/1999 Gibbs ..... 206/361
6,038,709 A * 3/2000 Kent ..... 4/255.05
6,109,429 A * 8/2000 Cunningham et al. ..... 206/15.2
6,241,091 B1 * 6/2001 Moore et al. ..... 206/349
6,338,406 B1 * 1/2002 Zagar ..... 206/362.2
6,378,719 B1 * 4/2002 Kaiser ..... 220/475
6,594,831 B1 * 7/2003 Pardo et al. ..... 4/300.3
6,622,316 B1 * 9/2003 Brown ..... 4/255.11
2003/0168364 A1 * 9/2003 Watlington ..... 206/349

* cited by examiner

*Primary Examiner*—Henry Bennett
*Assistant Examiner*—Amanda Flynn
(74) *Attorney, Agent, or Firm*—Michael S. Tavella

(57) ABSTRACT

A storage container for a toilet plunger. Two asymmetrical opposing clamshell doors form the base and lid of the container and are hinged together at the top of the container. When not in use the plunger head is held within the container with the plunger handle sticking up through a aperture in the top of the container. When the plunger is needed, the base and lid of the container are opened and spread across the toilet seat. The base and lid now protect the user from splashes that may occur due to their plunging of their toilet. The container automatically closes around the plunger head upon raising the plunger from the toilet, thus containing any water on the plunger within the container. Any water so trapped can evaporate through an evaporation slot in the container wall. Two sizes of container are taught, to accommodate every type of plunger made.

25 Claims, 17 Drawing Sheets

PLUNGER CONTAINER

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

The present invention relates generally to containers; and more specifically, to a toilet plunger container, asymmetrically clam-shaped and integrated with a plunger which is used to open clogged toilets, the container providing non-drip storage for the plunger when not in use.

2. Description of the Prior Art

Homeowners and business people commonly must use a toilet plunger to unclog their toilets. The process of plunging to unclog the toilet can cause contaminated toilet water to splash out of the toilet, in addition, contaminated toilet water can drip off the plunger onto the toilet bowel or toilet seat, and the floor as the user movers the plunger from the toilet to a toilet plunger storage device if the user has one.

Thereafter, inventors have created several devices to store the plunger in, and/or to control the spread of contaminated toilet water in the bathroom.

U.S. Pat. No. D425,744 issued on Jan. 26 1998 to John H. McGuire is a large storage device for a toilet plunger and toilet brush. This device takes up a large space in the bathroom. This device does not provide any splash protection to the user when the user is plunging their toilet. The user also risks dripping contaminated toilet water on the toilet bowl rim or toilet seat and on the floor when they move the plunger from the toilet to the storage devise.

U.S. Pat. No. 5,335,374 issued on Aug. 9, 1994 to Marilyn M. Wilk discloses a variety of rectangular, cylindrical, cone, or bell shaped cases that a toilet plunger rotates out of when the user wants to plunge their toilet. This device does not provide any splash protection to the user when the user is plunging their toilet. The user also risks dripping contaminated toilet water on the toilet bowl rim or toilet seat and on the floor or themselves when they rotate the plunger back into the case.

U.S. Pat. No. D292,631 issued on Nov. 3, 1987 to George Tash is a cup shaped holder that the user set the plunger in after use. While this devise will capture the contaminated toilet water dripping from the plunger once the plunger reaches the holder, the user would risk dripping contaminated toilet water on the toilet bowl rim or toilet seat and on the floor when they move the plunger from the toilet to the holder. This devise does not provide any splash protection to the user when the user is plunging their toilet. This device does not hide the plunger from view.

U.S. Pat. No. D383,935 issued on Sep. 23, 1997 to Frank W. Zawalsky discloses a plunger holder that has a cup shaped base in which the plunger head sits, and a sleeve that slips over the handle and top part of the plunger head. When the sleeve is lifted off the plunger germs that may have been transferred to the inside of the sleeve from the plunger head and bottom portion of the plunger handle could be spread to the upper portions of the plunger handle and ultimately contaminate the hands of the user. This device does not provide any splash protection to the user when the user is plunging their toilet. The user also risks dripping contaminated toilet water on the toilet bowl rim or toilet seat and on the floor when they move the plunger from the toilet to the storage device.

U.S. Pat. No. 5,099,527 issued on Mar. 31, 1992 to Lars D. Roose discloses a splash deflector disk that slips onto the handle of a toilet plunger. This disk provides splash protection to the user, but once the task is done, the user has to deal with the disk, which would be contaminated on the bottom side, and remains on the plunger handle. The user would have to get the contaminated disk off the plunger and store both somewhere, or leave the disk on the plunger and store them as a unit somewhere. Both the plunger and disk would drip on the toilet and floor. This invention adds to the user's storage problem.

U.S. Pat. No. 6,035,456 issued on Mar. 14, 2000 to John E. Taylor is a splashguard and storage apparatus. A disk with a hollow handle in its center that the plunger handle has been inserted through functions as the splash guard and as the top for the storage container that is shaped like a can. To get the plunger head out of the storage container, the user must rotate the plunger handle and in doing so rotate the disk. This unlocks the disk from the storage container. The plunger with disk attached to its handle can be moved toward the clogged toilet. Once at the toilet the user must move the disk up the plunger handle so that the disk does not get into the contaminated water of the toilet. Once the clog has been cleared, the user must move the disk back down the plunger handle before returning the plunger and attached disk to the storage container. The user risk dripping contaminated toilet water on the toilet bowl rim or toilet seat and on the floor when they move the plunger and attached disk from the toilet to the storage device.

BRIEF DESCRIPTION OF THE INVENTION

None of the above inventions and patents describes a device that, as a single unit, solves the three problems relating to storage of the plunger, drip prevention, and splash protection for the user.

The instant invention is a clamshell container that is hinged on top with an aperture for accepting a plunger handle. When not in use, a plunger head is held within the container with the plunger handle sticking up through the aperture. When the plunger is needed, the side of the container opens, allowing the user to spread the jaws of the container across the top of the toilet bowel. This allows the plunger head to be lowered into the toilet bowel for plunging. Once the plunging operation is complete, the plunger is lifted from the bowel. Once the plunger has risen sufficiently, the clamshell jaws close under the plunger head, catching any drips that might fall from the plunger. The container has a vent to allow liquid in the container to evaporate.

There are three embodiments of the invention. The first embodiment is a simple container for the plunger. The second embodiment has a wedge-shaped lid handle on the lid that allows the user to grasp the lid. The third embodiment is larger to accommodate a larger plunger head.

In operation, the user holds the plunger handle and positions the container so that the lid side of the container rests against the side of the toilet seat. Secondly, the user tilts the plunger handle toward the center of the toilet, and raises the plunger handle slowly until the lid opens. The user then stops raising the handle. The lower part of the container remains resting against the toilet seat. The user now swings the plunger head to the opposite side of the toilet. This action takes the lid across to the opposite side of the toilet seat. When a lid handle is present, the used can use the lid handle to move the lid across to the other side. The container is now open across the toilet seat. Any water that has dripped inside the container body by previous use has since evaporated or collected inside, and is prevented from dripping out and wetting the toilet seat by a containment dam.

Once the container is open over the toilet, the plunger head is automatically centered in the toilet bowel, and can be lowered for plunging to remove the clogging material. After use, the plunger is raised, and the clamshell container automatically close and prevents any water from dripping from the container as it is moved away. The container provides storage for the wet plunger, but allows the plunger to dry.

Accordingly, it is a principal object of the invention to provide a toilet plunger case.

It is a further object of the invention to provide a toilet plunger case capable of eliminating dripping after use.

It is a further object of the invention to provide a toilet plunger case capable of providing splash protection to the user.

These and other objects of the present invention will become readily apparent upon further review of the following specifications.

As a storage container, it is small and does not take up much space in the bathroom.

As a storage container, it totally conceals the plunger head.

As a storage container, it and the plunger can easily by move from one area to another. The user can, with one hand, grip the plunger handle and carry the plunger and container away as a single unit.

To prevent drips, the container opens and closes around the plunger head when the plunger head is directly over the toilet bowel. No contaminated water will drip on the toilet seat or bathroom floor.

No contaminated water will drip out of the container when the container is setting on the floor or when it is being moved to and from the toilet.

As a splashguard, the container covers most but not the entire toilet bowel opening. The user can see into the toilet bowel to observe the effectiveness of his or her plunging.

When the user is plunging his or her toilet the container is open over the toilet and the inter surfaces of the container face down into the toilet. Contaminated toilet water is likely to splash up on these surfaces and contaminate them. When the container is lifted off the toilet, these surfaces rotate to the inside of the container. These contaminated surfaces because they end up inside the container are not likely to contaminate the user. Drips off these surfaces will be contained inside the container.

My container is cheap to manufacture. It is made of two parts that are hinged together.

My container is easy to use.

Further objects and advantages of my invention will become apparent from a consideration of the drawings and ensuing descriptions.

DETAILED DESCRIPTION OF THE INVENTION

Figure 1:
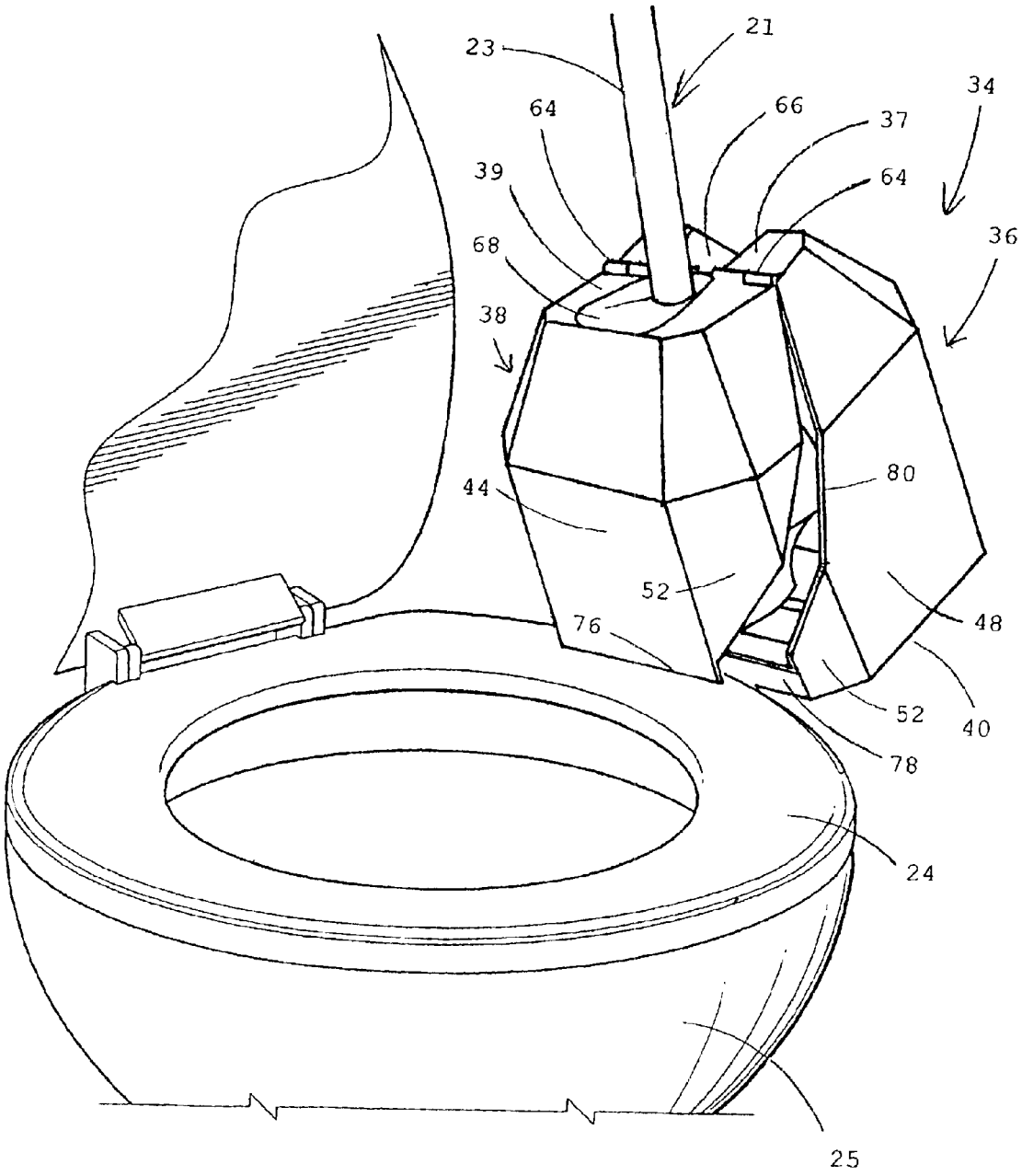
FIG. 1 is an environmental, perspective view of the first embodiment container with a plunger encased, resting on the side of a toilet seat in a first stage of use according to the present invention.

Referring now to FIG. 1, the first embodiment of a plunger container 34 is shown. This embodiment is designed for smaller sized plunger head 22, similar to that shown in FIG. 3. FIG. 1 shows the container 34 enclosing a plunger head 22. The plunger head is partially hidden and encased in its plastic container 34. In this view, the plunger handle 23 extends upward from the container 34. One side of the container 34 is shown resting on the side of a toilet seat 24 in a first stage of use.

As the plunger handle 23 is raised and moved over the center of the toilet bowl 25, the obliquely divided container 34 automatically separates because the lower front side wall 78 of the body 36 abuts the toilet seat and does not move, causing the lid 38 of the container 34 to move outward as shown.

Figure 2:
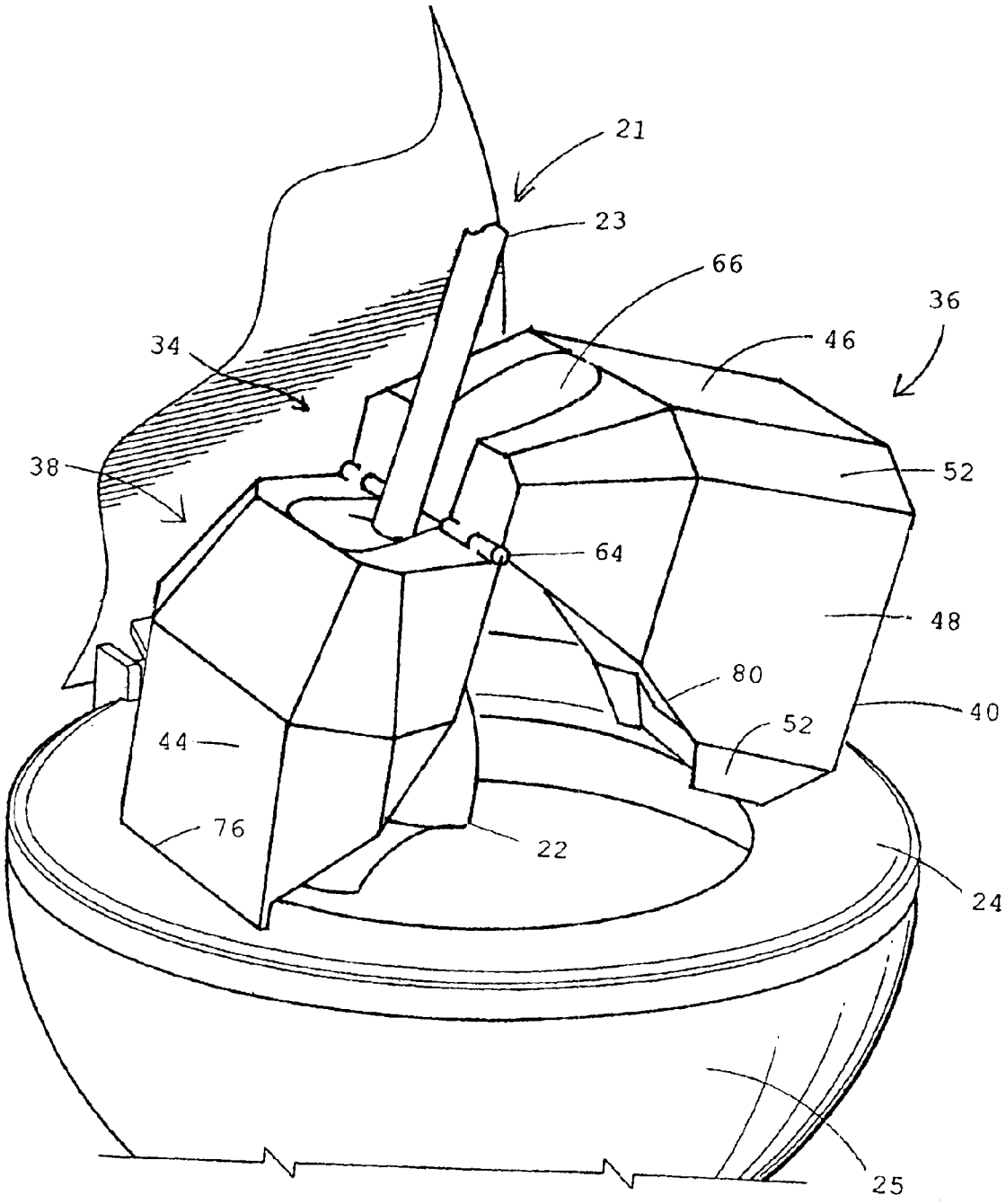
FIG. 2 is an environmental; perspective view of the first embodiment container with the plunger positioned over the toilet bowl with the container parts resting on the sides of the toilet seat in a second stage of use according to the present invention.

FIG. 2 is a view of the plunger 21 positioned over the toilet bowl 25 with the lid 38 being pushed across the toilet seat 24 by the plunger head 22, while the container body 36, rests on the toilet seat 24. This is the second stage of use.

Figure 3:
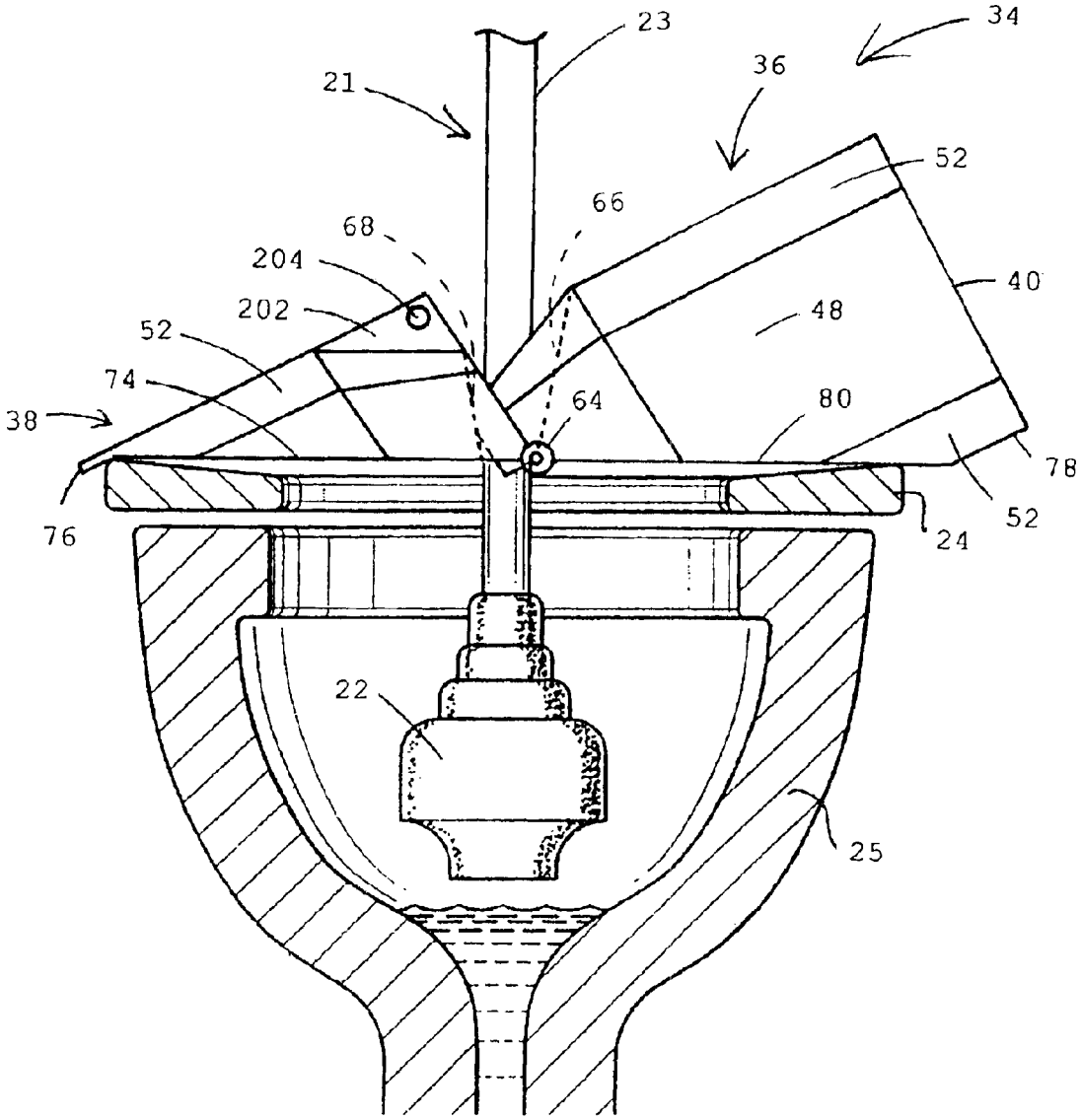
FIG. 3 is a sectioned front elevational view of the toilet bowl and a side elevational view of the first embodiment container with the plunger ready for use in a third stage of use according to the present invention.

FIG. 3 shows the plunger 21 fully in position over the toilet bowl 25 to begin plunging a blockage. Note that in this view, the lid 38 and the body 36 are shown resting on the toilet seat 24. This is the third stage of use.

As shown, the bottommost projection 76 of the lid 38 acts as the toilet seat positioning guide. Note that the top surfaces 39 of the lid 38 and top surfaces 37 of the body 36 abut to lock the opened container 34 in place on the toilet seat 24 and toilet bowl 25.

Figure 4:
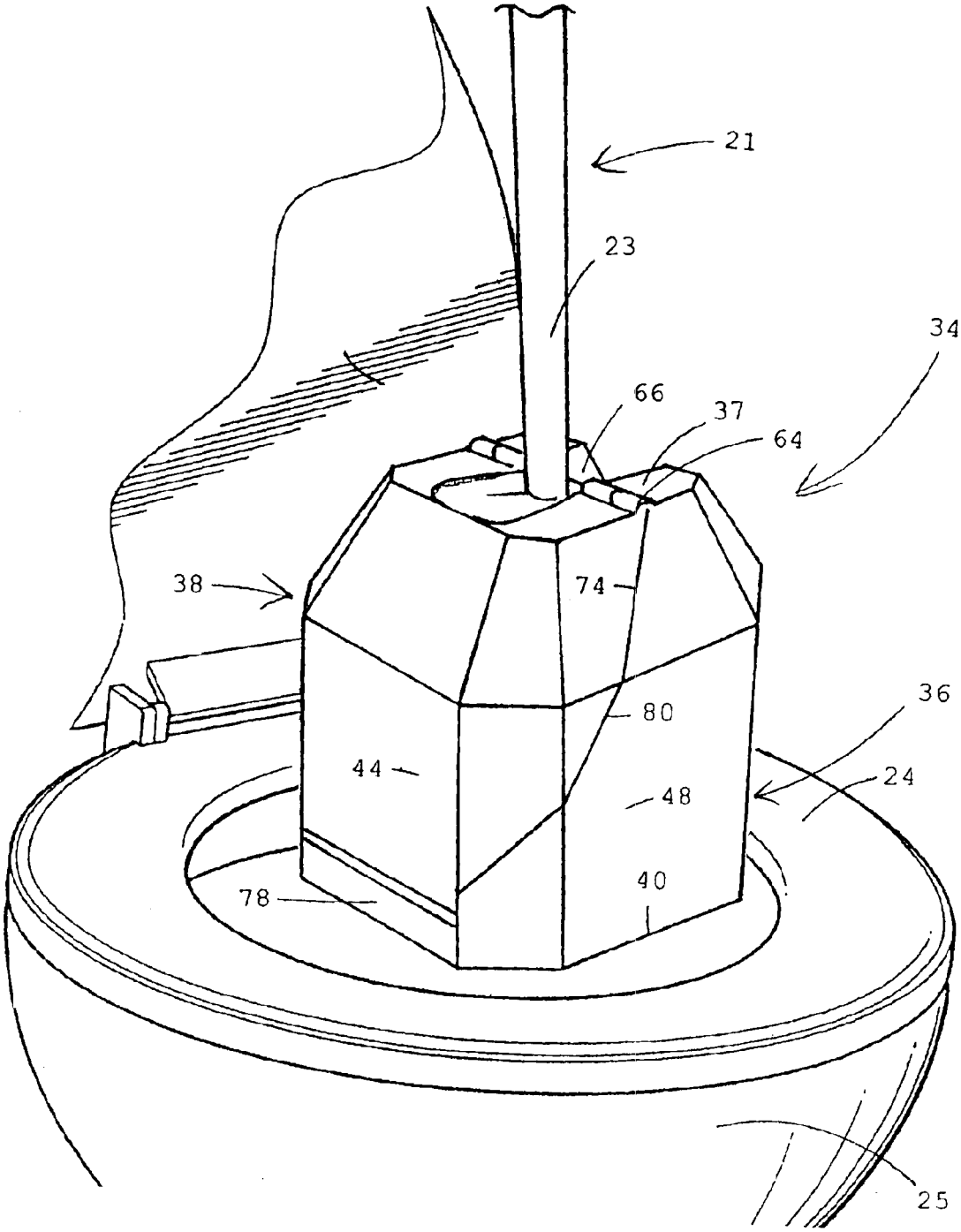
FIG. 4 is an environmental, perspective view of the container in the process of removing the plunger vertically enabling the container halves to enclose the plunger automatically in the fourth and final stage of use according to the present invention.

FIG. 4 shows the container 34 being removed from the toilet. In this view, the lid 38 and body 36, automatically enclose the plunger head 22 as the plunger 21 is lifted up from the toilet. This shows the fourth and final stage of use. Because the container fully encloses the plunger head, there are no drips, no mess, no worry of dripping, and no waiting for drips to stop. The plunger can be immediately returned to its storage location.

The two-piece container 34 is large enough to contain the heads of most standard size toilet plungers. The general shape of the container 34 can be a four-sided box, a cylindrical container, or any shape as long as the container does not interfere with the functions of the plunger. The two-piece container 34 is made of rigid plastic or any other suitable material.

In the embodiments shown in FIGS. 1 to 9, the container 34 has a cross-sectional shape of an octagon with four larger sides, i.e., a front side wall 44, back side wall 46, a right side wall 48, and left side wall 50, and four smaller sides 52, which form the remaining parts of the octagon shape of the container 34. Approximately the upper third of these sides angle in toward the flat top forming an eight-sided dome. The container 34 has a recessed bottom 42.

FIGS. 5 to 9 are drawn to a second embodiment. This embodiment has a lid-opening handle 202, formed on the lid portion 38. In this embodiment, the container 34 is opened with using the handle 202. In the preferred embodiment, the handle 202 has a plurality of projecting knobs 204 that represent textured surfaces for increasing gripping friction.

As in the first embodiment, the top portions 39 of the lid 38 and 37 of the body 36 abut to prevent the container from opening further. This locking position maintains the container 34 from dropping any lower than the level of the toilet seat 24 and ensures the container is not contaminated by the water contained in the toilet bowl 25. Moreover, the lock also establishes the degree of opening of the container 34 over the toilet seat 24 that helps to establish the proper alignment of the plunger head 22 relative to the toilet bowl 25.

An aperture or an arcuate plunger surface cavity 54 for the plunger handle 23 in the container flat top portion 39 of the lid 38 is centered and recessed. Three sides of the aperture, i.e., left edge 56 and right edge 58, which are the plunger head contact rails, and the semicircular edge 60, which connects the two edges or rails 56 and 58 are recessed in the lid 38. (see FIG. 7). The fourth edge 62 of the aperture 54 is not recessed and is on the top portion 37 of the body 36 and spans the distance between the two hinges 64 as shown. This arrangement ensures that the size of the plunger handle aperture 54 remains constant, and is never too large when the container 34 is closed, opened or in use. An oversized aperture adversely affects the alignment of the toilet plunger 21 when the container 34 is closing. The plunger's rod handle 23 must be kept in the center of the container 34 when it is being closed. If this centered position is not maintained, the lid 38 and the container body 36 will not rotate correctly to a closed position. This arrangement also ensures that the aperture 54 is never too small when the two-piece container 34 is either at rest, in use, opening or closing. If the aperture 54 is too small, the plunger rod handle 23 can bind with the lid 38 and container body 36.

Figure 6:
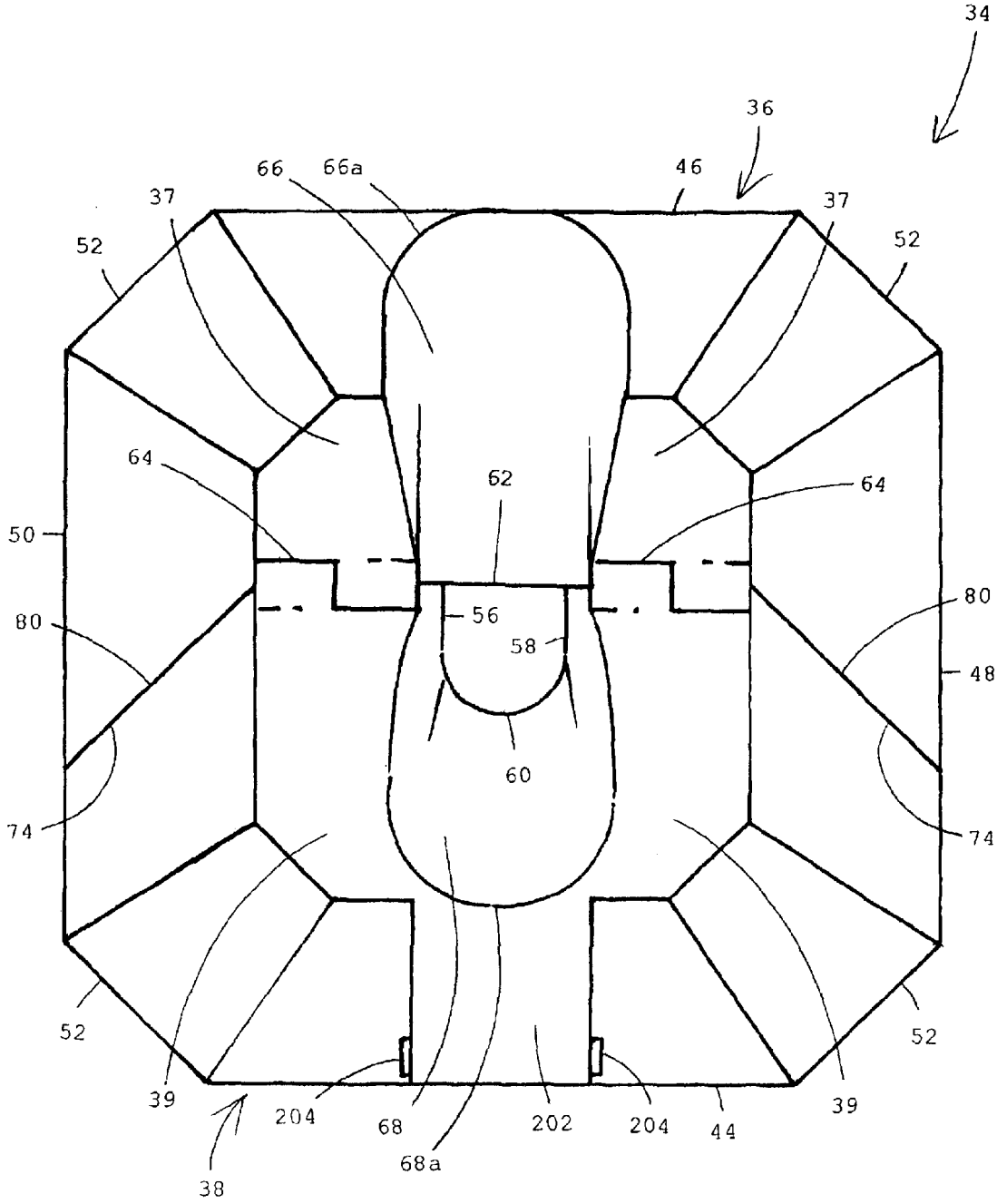
FIG. 6 is a top plan view of the second embodiment of the container.

As shown in the figures, and particularly FIG. 6, there are two hinges 64 located on top of the container 34 on either side of the aperture 54. The hinges 64 are positioned off center toward the side of the body of the container a distance equal to one-half the width of the aperture 54, therefore the axis of the hinges 64 is the same as the edge that is the fourth edge 62 of the aperture 54. The location of the axis of the hinges 64 is critical to the proper operation of the container 34.

Figure 5:
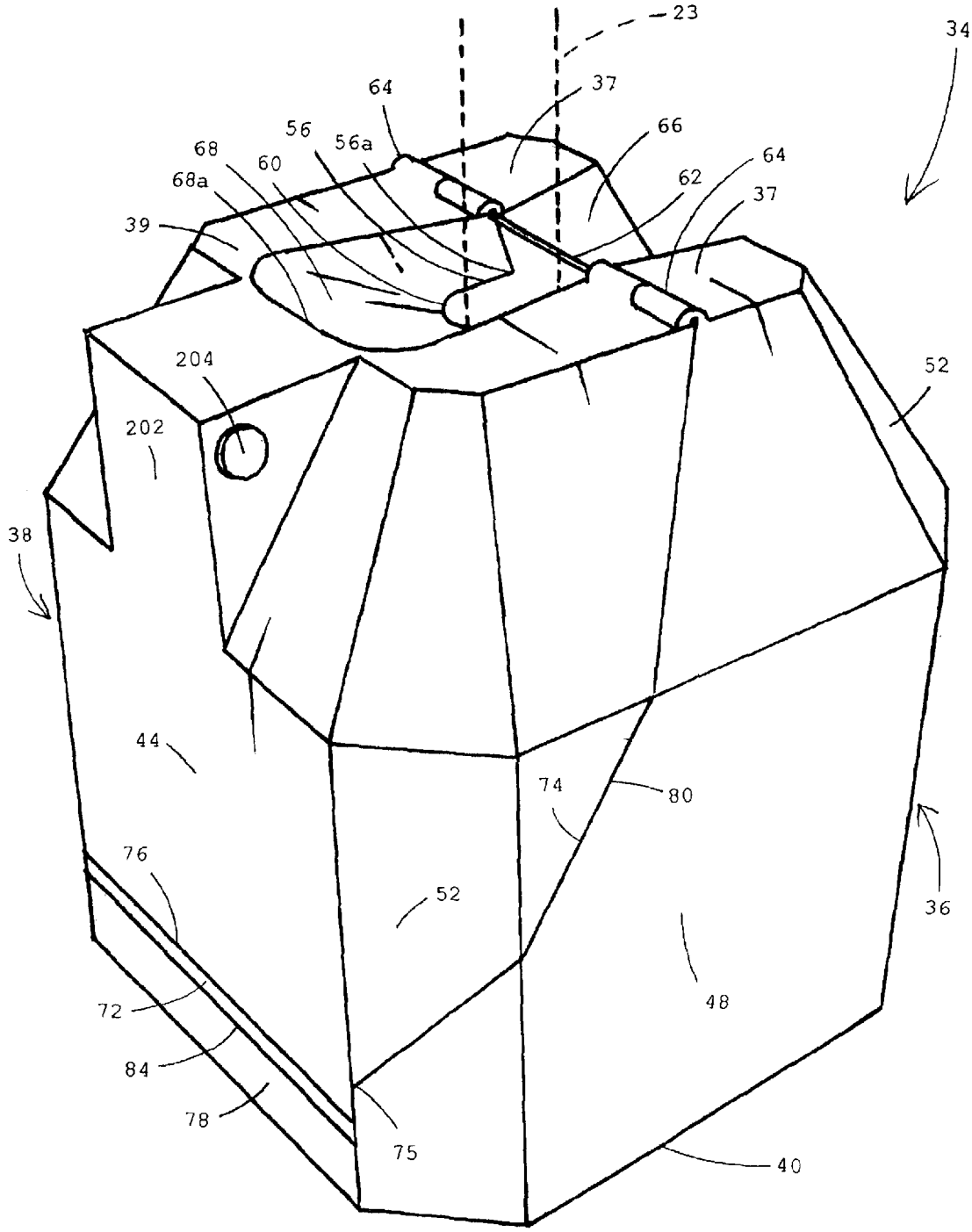
FIG. 5 is a perspective view of a second embodiment of the container having a wedge-type handle on the upper portion of the lid, with the plunger handle in shadow.
Figure 7:
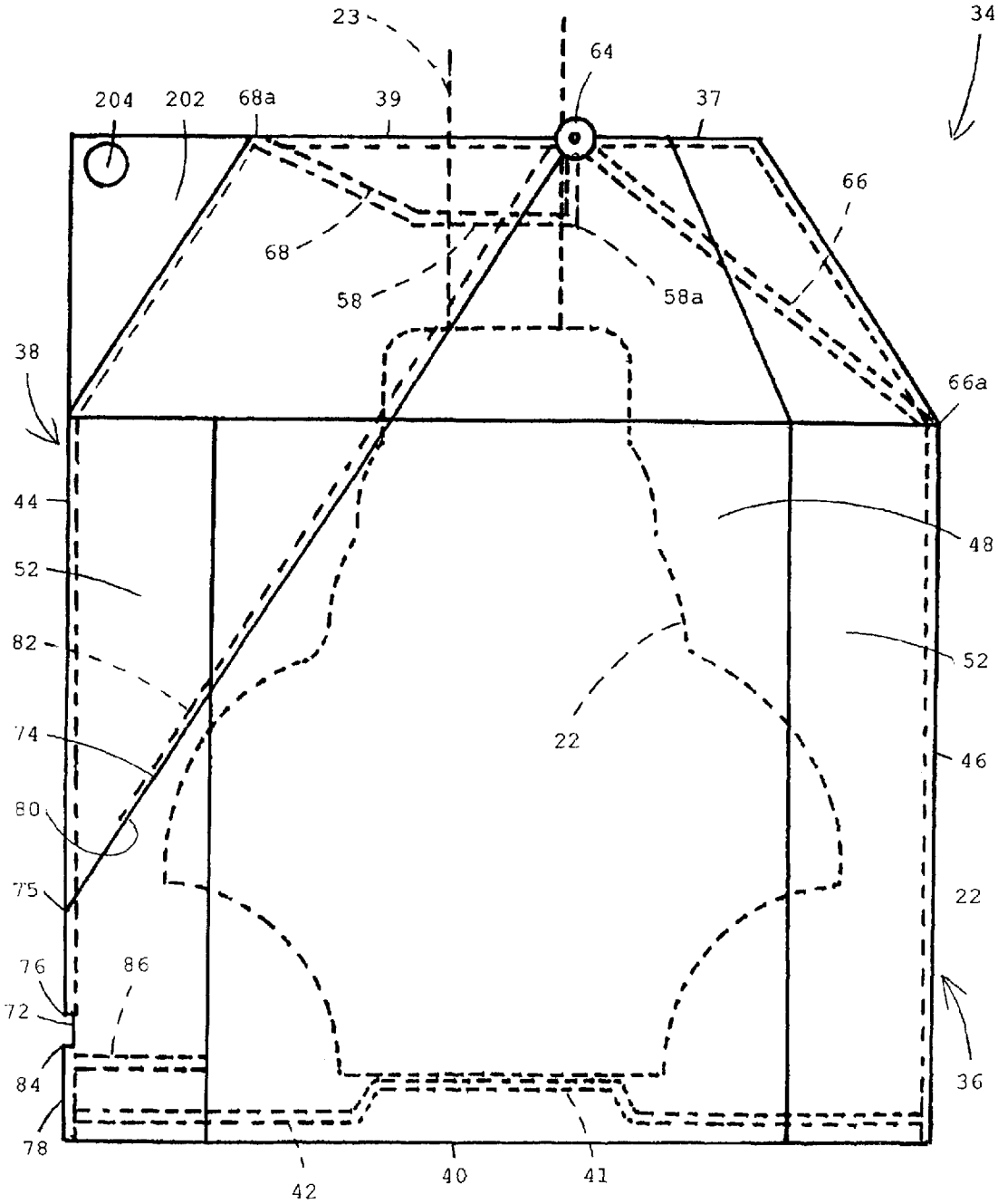
FIG. 7 is a side elevational view of the second embodiment container with the plunger partially shown in shadow.
Figure 8:
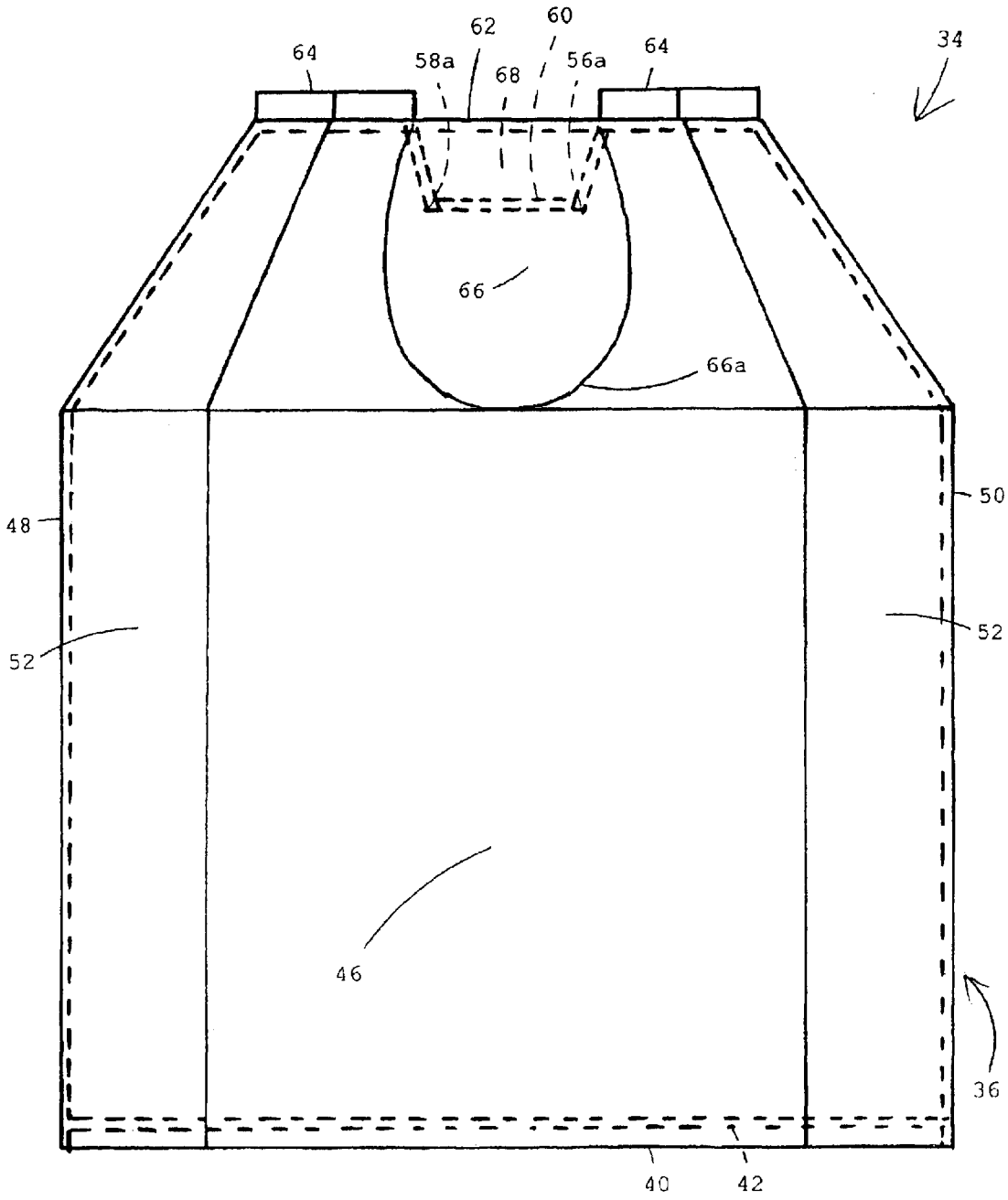
FIG. 8 is a rear elevational view of the second embodiment of the container.

There are two guide surfaces 66 and 68 that are located on the top of the body 36 and lid 38 of the container 34 respectively. On the lid 38, the guide surface 68 angles down from the back edge of the lid 38 near the handle 202 to the three edges 56, 60 and 58 of the aperture 54 (FIGS. 5 and 7). On the container body 36, the guide surface 66 angles down from the unrecessed fourth edge 62 of the aperture 54 to approximately one third of the way down side wall 46. Note that both guide surfaces 66 and 68 have curved outer edges 66*a* and 68*a* as shown in FIG. 6.

Figure 17:
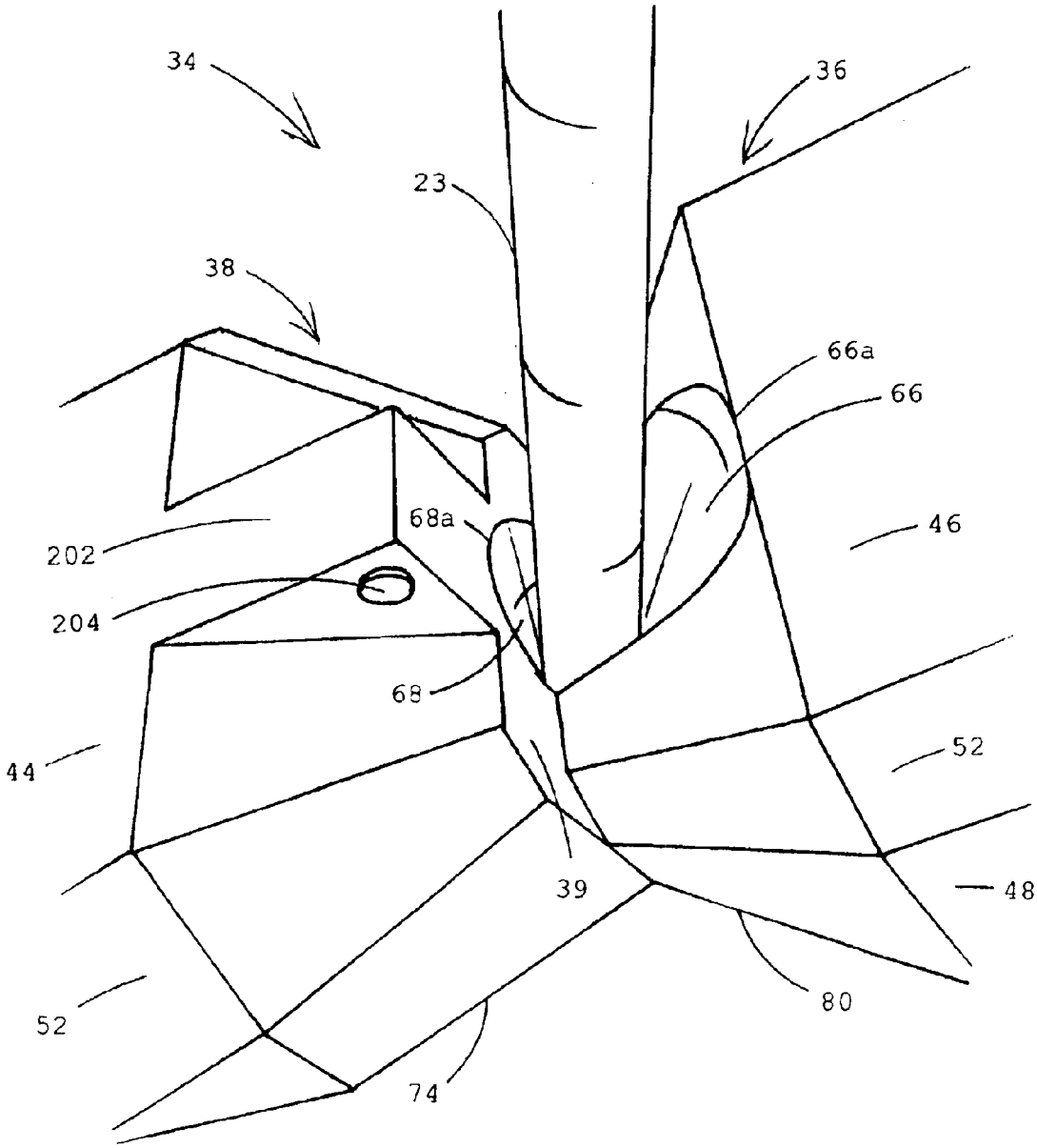
FIG. 17 is an environmental perspective detail view of the container in the open position with the toilet plunger handle passing through the aperture.

When the plunger 21 is being utilized, the guide surfaces 66 and 68 come together to form an inverted cone open at the aperture 54 (FIG. 17). This conical structure helps to control the angle of the plunger 21 when the plunger is being used to unclog the toilet bowl 25.

Figure 13:
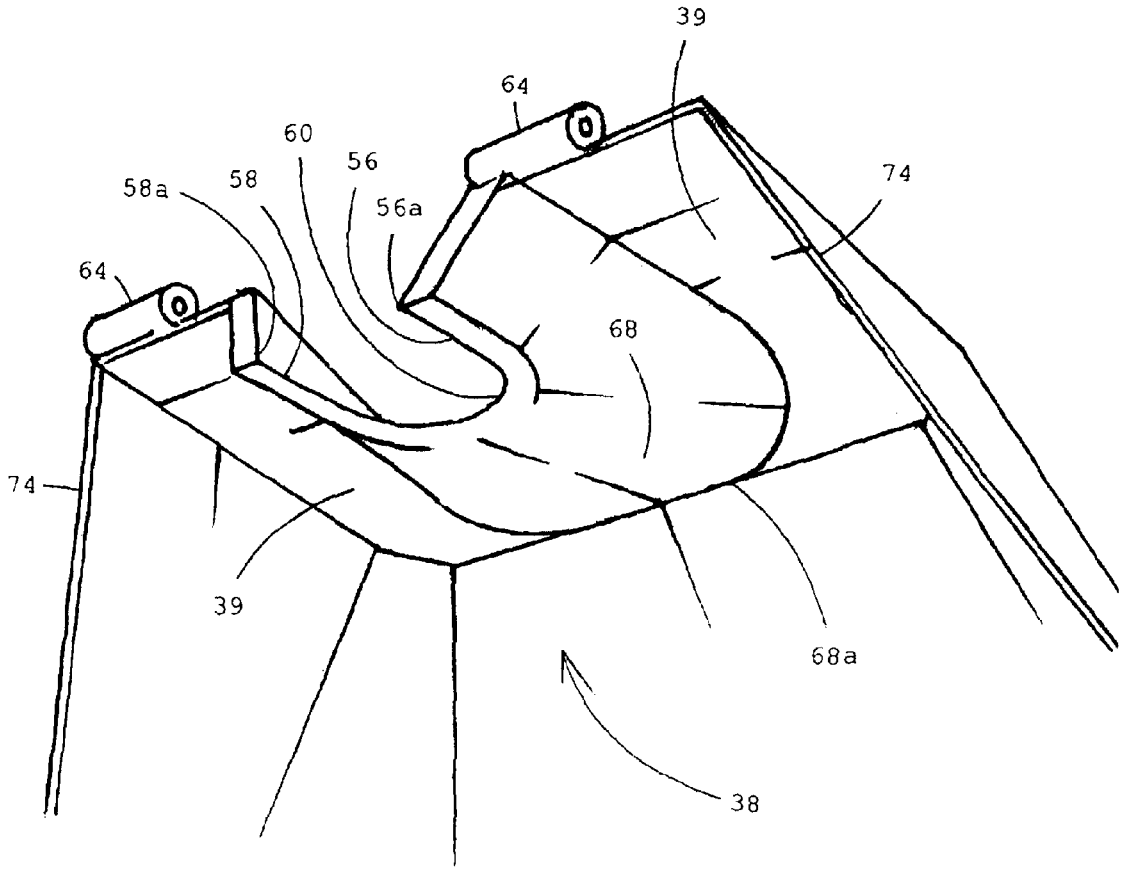
FIG. 13 is a perspective detail view of the first embodiment looking up at the inside of the lid.

As the plunger 21 is raised vertically, the top of the plunger head 22 comes into contact with tips 56*a* and 58*a* located at the front of the left and right edges 56 and 58, respectively, of the aperture 54 as shown on FIG. 13. As the plunger 21 continues up vertically, the lid 38 and body 36 of the container 34 close around the plunger's head 22 due to the weight and center of gravity of the lid 38 and body 36. For this reason, the left and right edges 56 and 58, respectively, of the aperture 54, are called contact rails and the tips 56*a* and 58*a* of the rails are called contact tips.

When closed, the left and right rails 56 and 58, respectively, of the aperture 48 rest on the top of the toilet plunger head 22. In this position, the user holds the plunger handle 23; the lid 38 and container body 36 are suspended from the top of the plunger head 22.

Once the plunger's head 22 is inside the container 34, the container 34 can be placed on the floor without any dripping because the plunger head 22 comes to rest on the evaporation ridge 70 (FIG. 14) that is part of the watertight bottom 42 of the container 34.

The diagonal side edges 74 of the lid 38 first angle down from the hinges 64 to a point slightly above the evaporation slot 72 (FIGS. 5 and 7), which is an opening between the bottom edge 76 of the lid 38 and the container body 36.

The angle of the diagonal side edges 74 is also such that when the container 34 is fully open, the edges 74 of the lid 38, and the corresponding diagonal side edges 80 of the sides 48 and 50 of the body 36 create a substantially straight line across the toilet seat 24 as shown in FIG. 3.

When the plunger 21 and container 34 are lifted off the toilet, the container body 36 pivots off the toilet seat 24 at the knee 75, which is slightly above the evaporation slot 72. This ensures that the top edge 84 of the lower front side wall 78 of the body 36 does not snag the toilet seat 24 when the plunger 21 and container 34 are lifted.

The indented closing guides 82 (shown in dashed lines decreasing in depth from the top in FIG. 7) formed on opposite sides of the lid 38 ensure that the side edges of the lid 38 and the body 36 come together properly.

The bottom edge 76 of the lid 38 extends over the edge of the toilet seat 24 slightly when the container 34 is on the toilet seat 24 as illustrated in FIG. 3. This overhang 76 helps to keep the container 34 positioned correctly on the toilet seat 24 when the plunger 21 is being used.

As discussed above, the evaporation slot 72 is a rectangular horizontal opening between the bottom edge 76 of the front side wall 44 of the lid 38 and the top edge 84 of the lower front side wall 78 of the body 36. It allows water entrained in the container 34 to evaporate.

Figure 9:
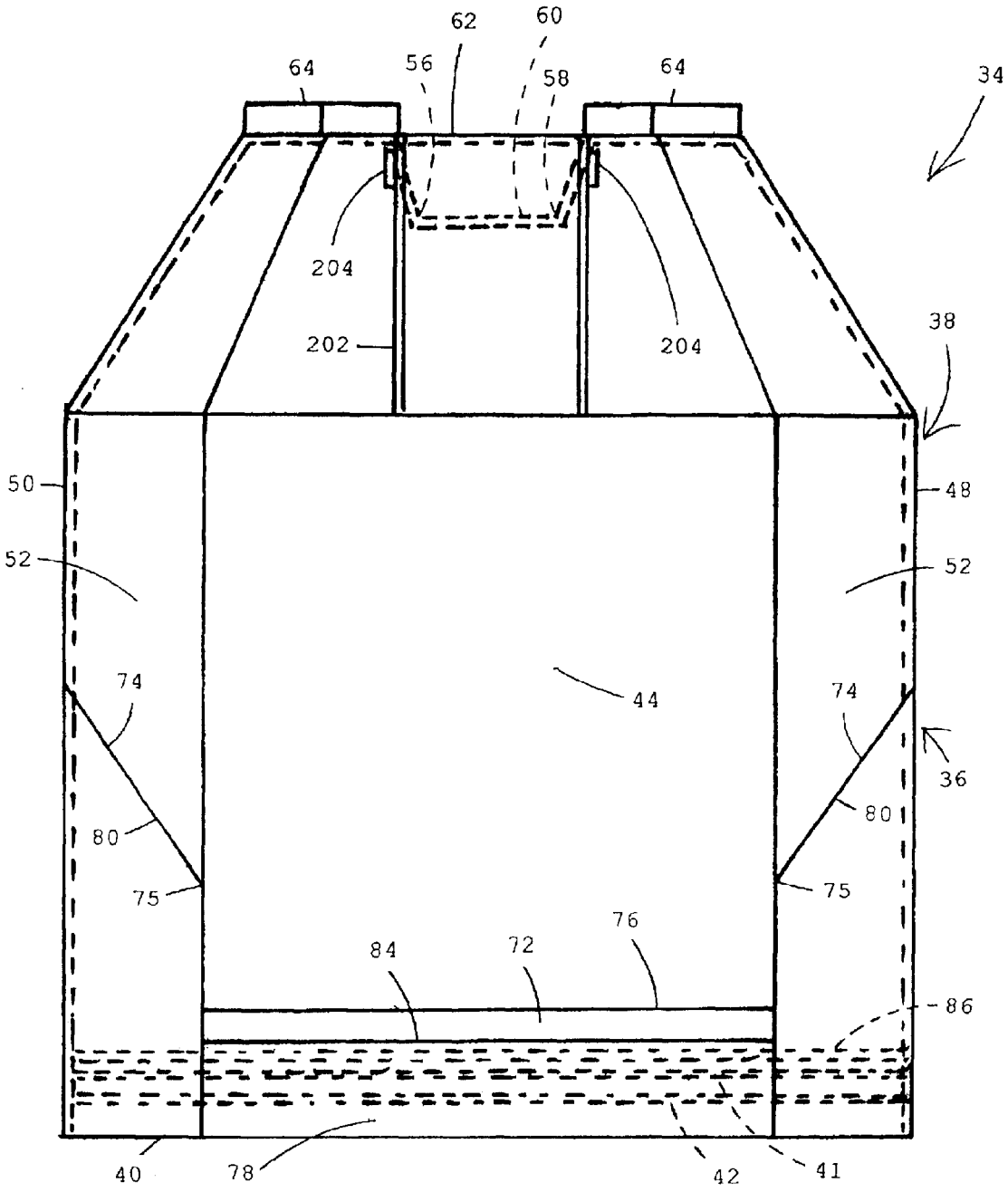
FIG. 9 is a front elevational view of the second embodiment of the container.
Figure 10:
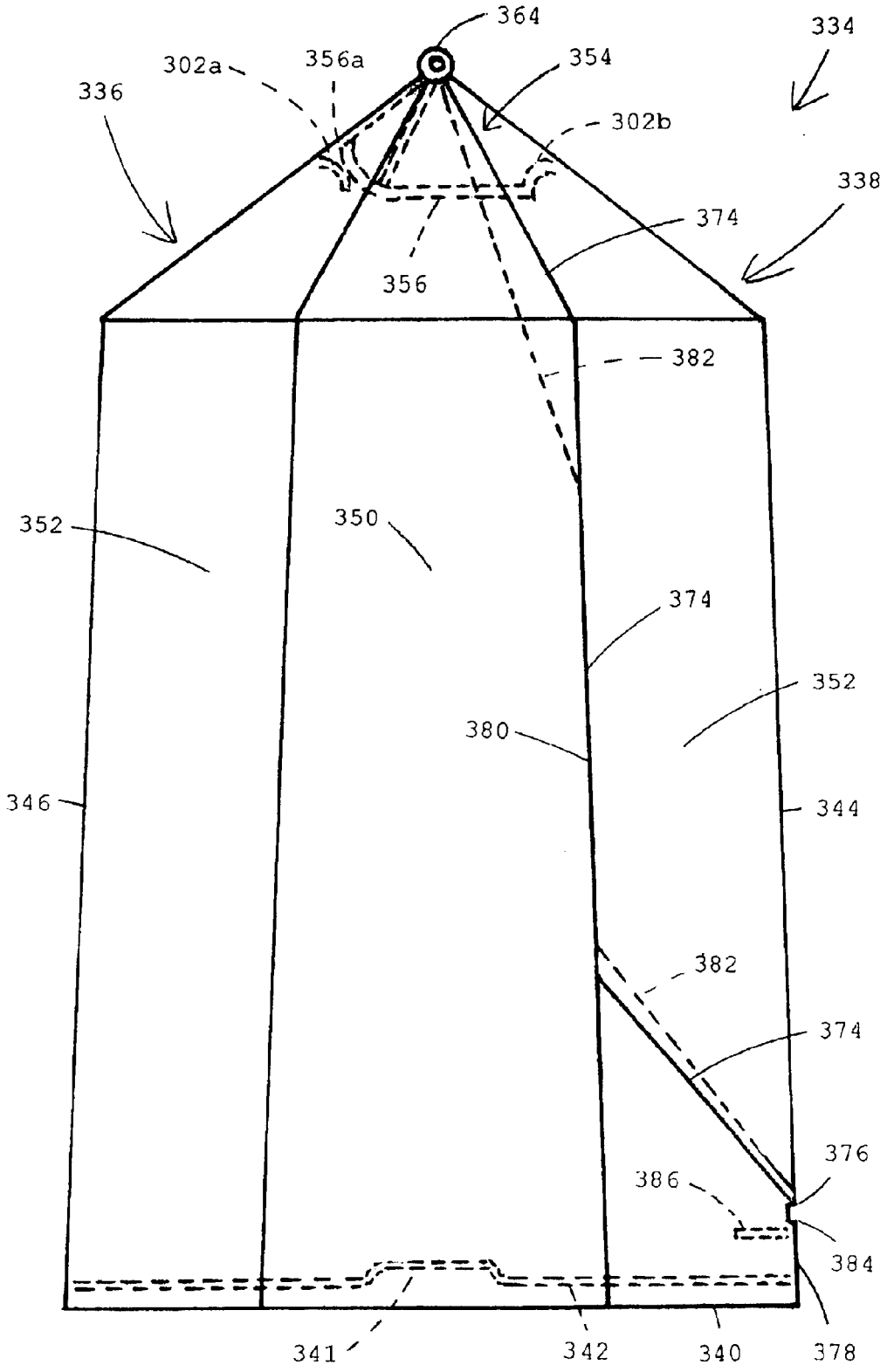
FIG. 10 is a left side elevational view of the third embodiment of the invention, having a larger plunger container suitable for larger plungers.
Figure 14:
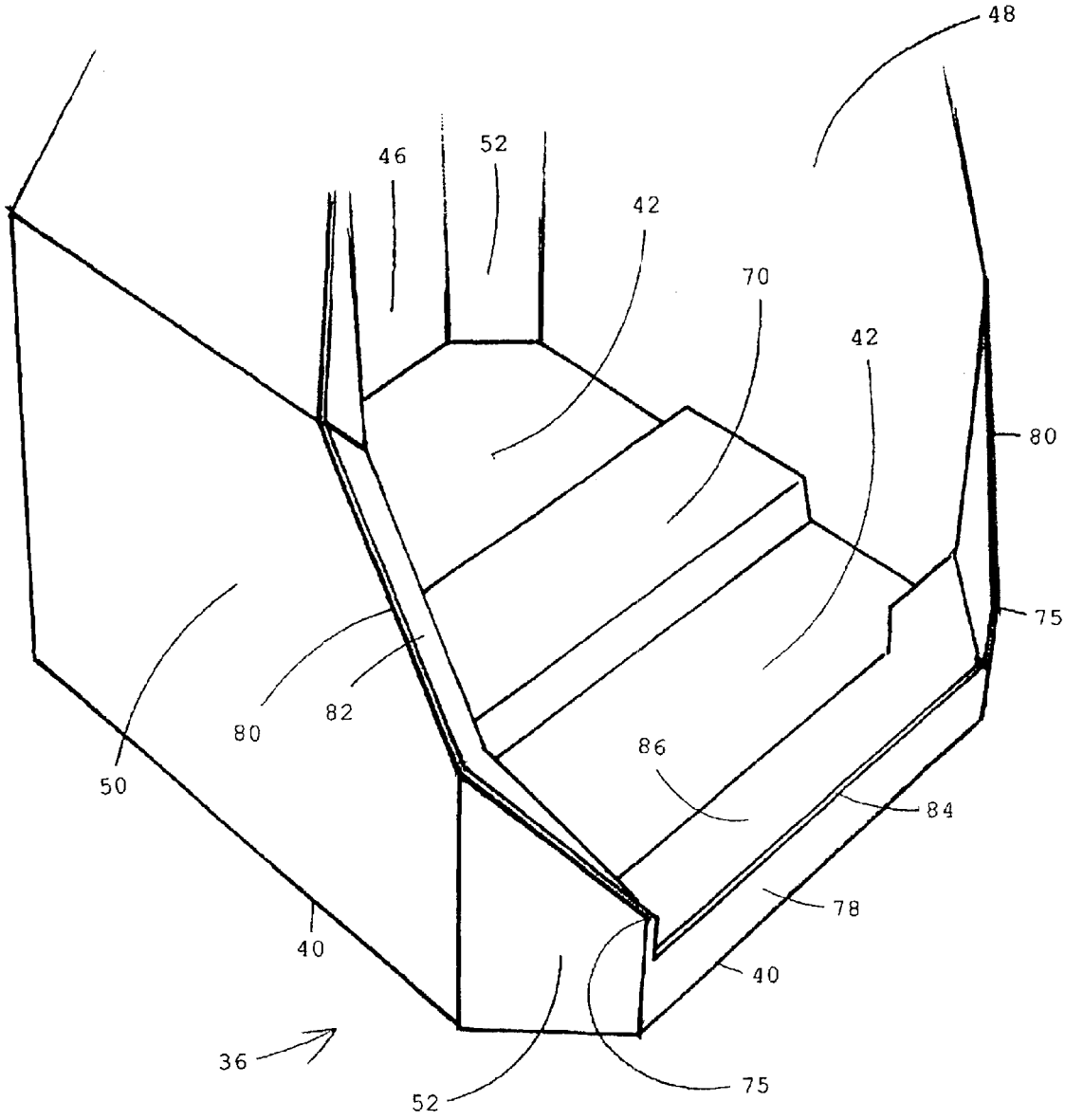
FIG. 14 is a perspective detail view of the first embodiment looking down at the inside of the body.

Referring now to FIGS. 7, 9, and 14, a moisture containment dam 86 is formed on the inside of the lower front side wall 78 of the body 36, just below the evaporation slot 72. The moisture containment dam 86 extends along the entire width of the body 36, to meet the left and right secondary side walls 52 as shown. The dam 86 extends back into the container 34 as shown in FIGS. 7 and 14, giving the dam 86 a thickness substantially greater than that of a side wall of the container. The dam 86 ensures that any water collected in the bottom 42 of the container 34 is contained when the container is placed on the floor or tilted horizontally in use over the toilet bowl 25.

The evaporation ridge 70 shown in FIG. 14 is formed in the center of the bottom 42 of the container 34 and extends from the right side wall 48 to the opposite side wall 50. The evaporation ridge 70 prevents a watertight seal from forming between the plunger head 22 and the bottom 42 of the container 34. The evaporation ridge 70 allows air to circulate under the plunger head 22 to aid in the speedy evaporation of any fluid. When the evaporation ridge 70 is formed, it creates an indentation 41 in the underside of the bottom 42 of the container 34 as shown in FIGS. 7 and 9. This indentation provides an additional benefit in that it conforms to the shape of hinges 62 that stick up above the top of the container 34, which accommodates stacking the empty containers 34 on store shelves or in storage.

The watertight bottom 42 is recessed in the center to maintain most of the container bottom 42 off the floor when the container is placed on the floor.

Referring now to FIGS. 10, 11, 12, 15, and 16, the third embodiment of a plunger container 334 is shown. This embodiment is a larger version suitable for use with one of the larger accordion style rubber toilet plunger heads, shown in FIG. 12. These heads 27 are threaded on the threads 29 of the handle rod 28 such as the MASTER PLUNGER manufactured by G.T. Water Products, Inc. of Moorpark, Calif.

The container 334 can be shaped as a box, cylinder and the like, having parts which do not interfere with the basic functions of the plunger 26. The preferred cross-sectional shape of the container 334 is that of a polygon having a substantially conical polygonal top portion and a generally octagonal base portion. The octagonal base has four primary sides, i.e., lower front side wall 378, back side wall 346, right side wall 348, and left side wall 350 and four secondary sides 352, which, in the preferred embodiment, are tapered from the top to the bottom as shown. The top portion of the container 334 consists of planar surfaces that slope up from the side toward the centered plunger handle aperture 354.

Two hinges 364 are located on top on either side of the aperture 354. The container 334 preferably made of rigid plastic.

The plunger handle 28 and the accordion style plunger head 27 can be unscrewed by unthreading from each other in order to place the large plunger head 27 inside the container 334.

As shown, the aperture 354 is an opening formed between the lid 338 and the body 336. As in the case of the first embodiment, this ensures that the aperture maintain its proper size during all stages in the use of the device. It should be noted that too large an aperture 354 during use would adversely affect the alignment of the plunger head 27 when the container 334 is closing. This structural arrangement ensures that the aperture 354 maintains its proper diameter whether opening, closing, or in use. If the size of the aperture 354 is not controlled; the container body 336 and the lid 338 will not rotate to the closed position properly; and if the aperture 354 is too small in diameter, it can cause the plunger handle 28 to bind in the aperture 354.

A pair of curved plunger handle guide edges 302*a* and 302*b*, form the edge of the aperture 354 ensures that the threads 29 of the plunger handle 28 do not snag in the aperture 354. Curved plunger handle guide edge 302*a* forms the edge of the half of aperture 354 that is part of the body 336. Curved plunger handle guide edge 302*b* forms the edge of the half of aperture 354 that is part of the lid 338.

Figure 11:
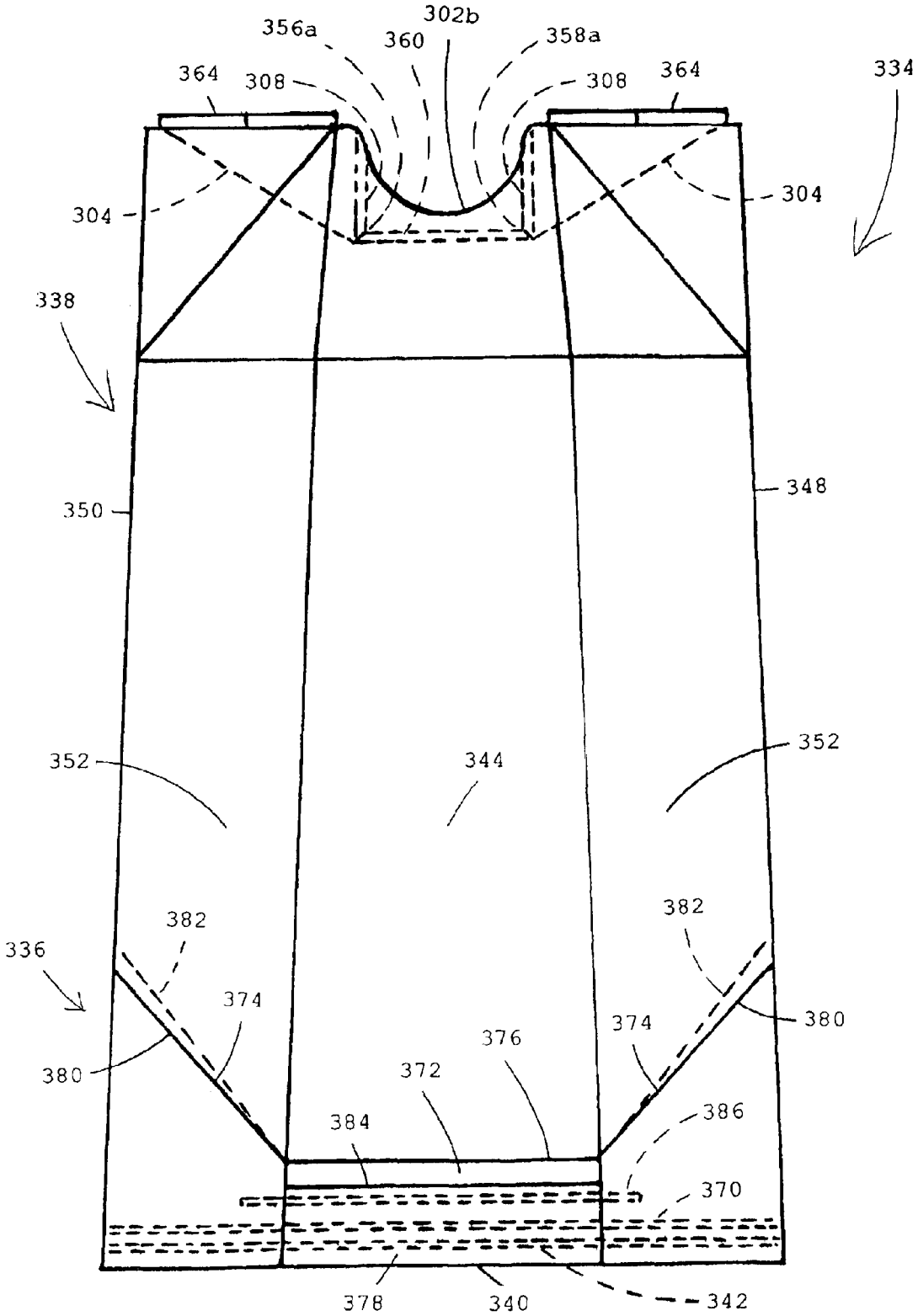
FIG. 11 is a front elevational view of the third embodiment device.
Figure 12:
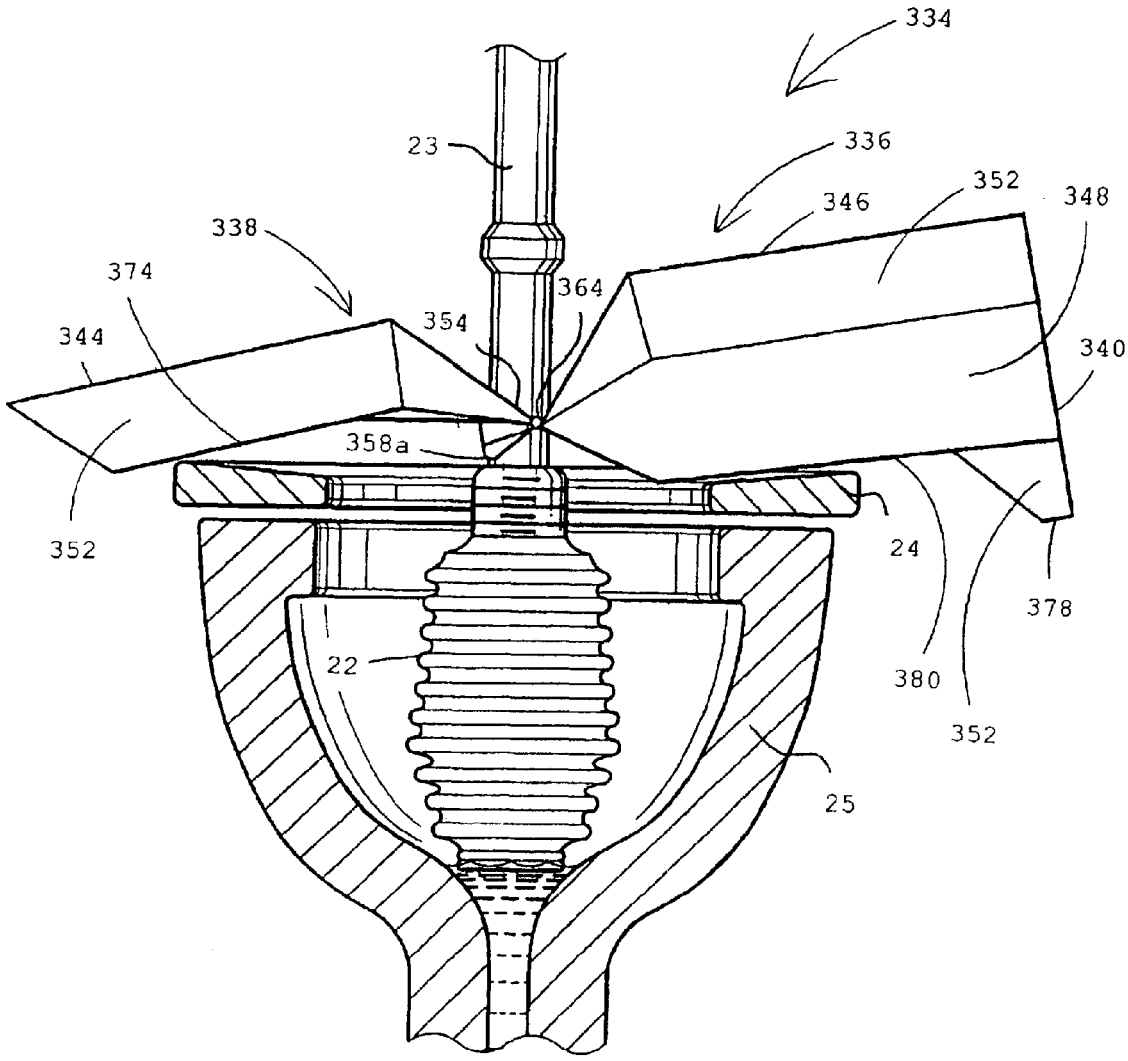
FIG. 12 is a front elevational view of a partially sectioned toilet bowl and seat, and a right side elevational view of the third embodiment device positioned on the toilet bowl and seat with an oversized plunger head.
Figure 15:
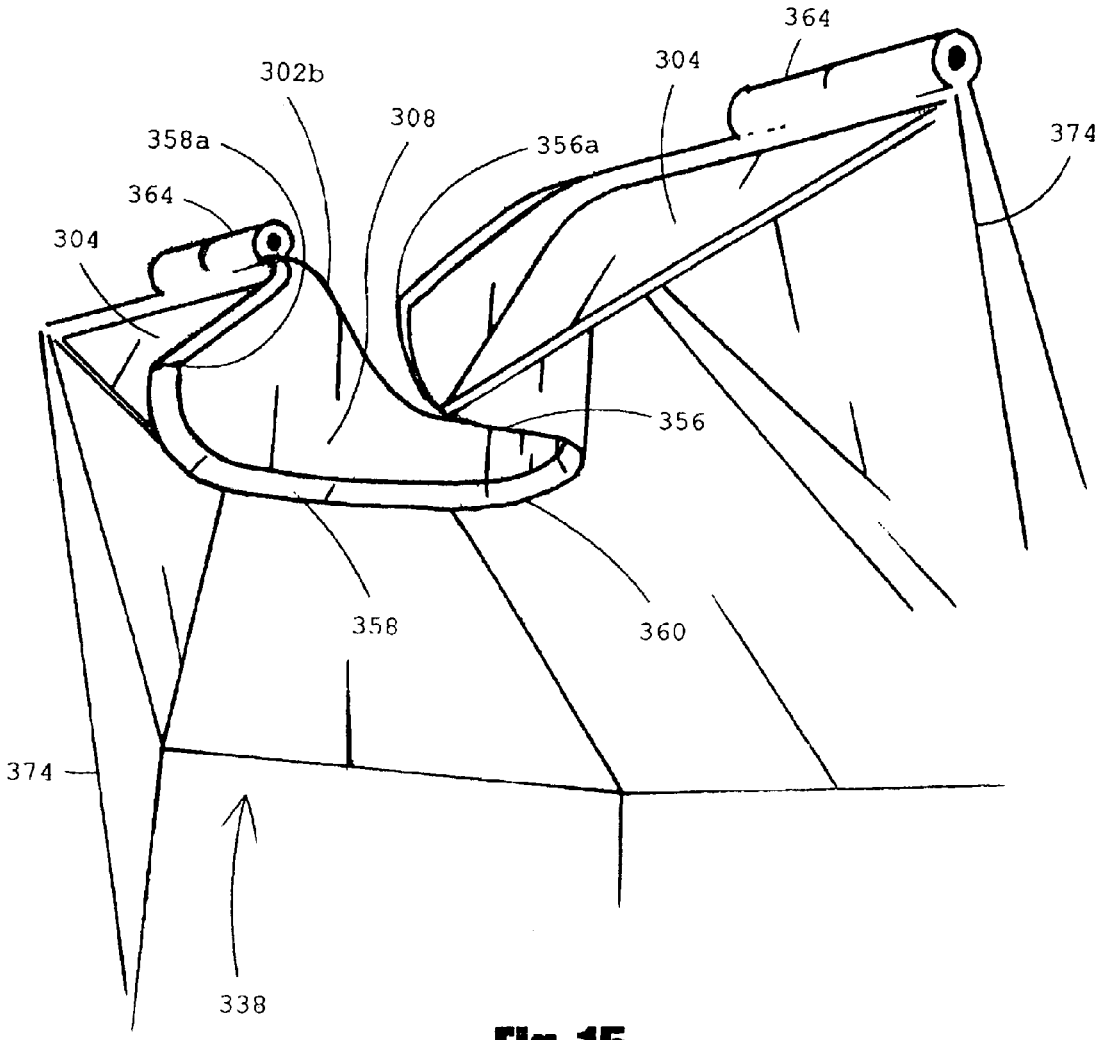
FIG. 15 is a perspective detail view of the third embodiment looking up at the inside of the lid.

Note that the plunger head contact rails 356 and 358 and semicircular edge 360 are located on the bottom edge of the inner surface that extends down into the area of the container 334 from the curved plunger handle guide edge 302*b* of the lid 338 side of the aperture 354 and is beveled. As shown in FIGS. 11 and 15 the beveled plunger head contact rails 356 and 358 are located on the left and right sides of the bottom of the inter cylindrical surface 308 of the aperture 354. The semicircular beveled edge 360 of the contact rail curves around the back (lid side) of the bottom of the inter cylindrical surface 308 of the plunger handle aperture 354. The left and right sides of the beveled plunger head contact rails 356 and 358 extend out toward the body side of container and angle up to the beveled contact tips 356*a* and 358*a*. A pair of linear support braces 304 positioned on opposite sides in the lid 338 supports the inter cylindrical surface 308.

The beveled contact tips 356*a* and 358*a* are on the open side of the beveled contact rails 356 and 358 where it faces towards the body 336 side of the container 334. The plunger head contact rails 356 and 358 and the contact tips 356*a* and 358*a* are beveled to accommodate the shape of the accordion style plunger head 27. The beveled plunger head contact tips 356*a* and 358*a* first contact the top of the plunger head 27 when the user lifts the plunger 26 out of the toilet bowl 25. As the plunger 26 is raised vertically, the lid 338 and body 336 close around the plunger head 27 due to their weight and their centers of gravity. When closed, the beveled plunger head contact rails 356 and 358 rests on the top of the toilet plunger head 27. In this position, the user holds the plunger handle 28; the lid 338 and container body 336 are suspended from the top of the plunger head 27.

Once the plunger head 27 is covered by the container 334, the container 334 can be placed adjacent the toilet or stored elsewhere. As the container 334 is placed on the floor, the bottom of the plunger head 27 comes to rest on an evaporation ridge 370, which is formed in the recessed bottom 340 of the container 334. From the hinges 364, the edges 374 of the lid 338 angle down the edges of the container 334. About two-thirds of the way down the sides, the lid's edges 374 angle across the two secondary sides 352 to the bottom edge 376 of the front side wall 344 of the lid 338. The two dashed lines 382 in FIG. 10 designate the lid closing guides on each side of the container body 336, which are indented to aid the proper closing of the container 334. The irregular edges of the lid 338 meet the top corners of the evaporation slot 372.

The lid closing guides 382 ensure that the edges of the lid 338 and the body 336 come together to close properly.

The evaporation slot 372 is an opening between the bottom edge 376 of the front side 344 of the lid 338 and the top edge 384 of the front side wall 378 of the container body 336. This evaporation slot 372 allows water collected in the container 334 to evaporate.

Figure 16:
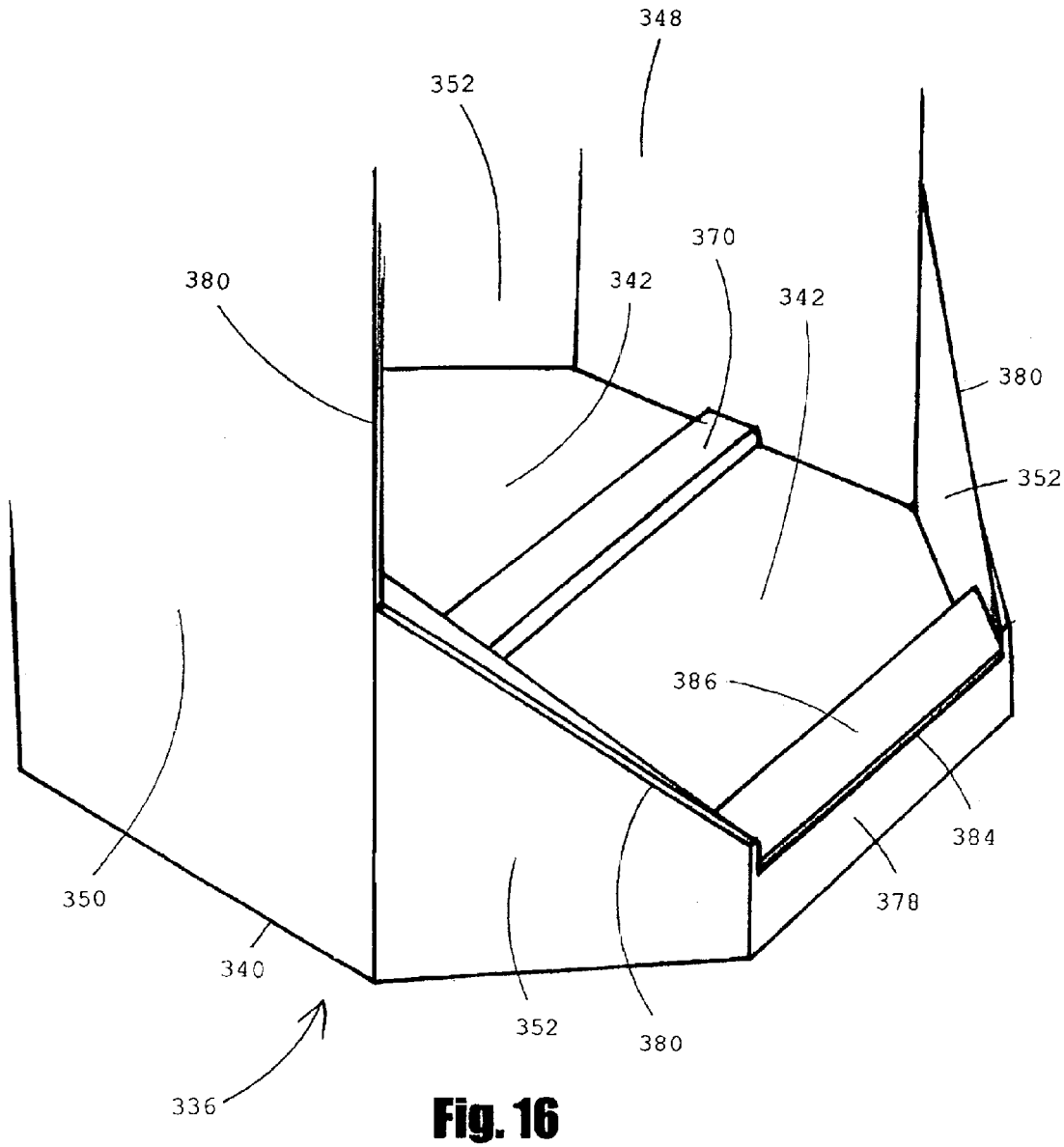
FIG. 16 is a perspective detail view of the third embodiment looking down at the inside of the body.

The moisture containment dam 386 as shown in FIG. 16 is formed on the inside of the lower front side wall 378 of the container body 336 just below the evaporation slot 372. The dam 386 is extends across the front side wall 378 to the secondary sides 352 adjacent to the front side wall 378. The dam 386 extends from these three sides toward the center of the container body 336. As shown, the dam 386 has substantial thickness compared to the thickness of the side walls.

The moisture containment dam 386 ensures that moisture collected in the bottom is contained whether the container 334 is seated on the floor or tilted horizontally when in use over the toilet bowl 25.

An evaporation ridge 370 as shown in FIG. 16 is formed in the center of the container's recessed bottom 342 and extends from one side of the container 334 to the opposite side. The evaporation ridge 370 prevents a watertight seal from forming between the toilet plunger head 27 and the bottom 342 of the container 334. The evaporation ridge 370 allows air to circulate under the plunger head 27 ensuring speedy evaporation of any collected fluid. The watertight bottom 342 is also recessed up in the body 336 and, therefore, does not touch the floor when the container 334 is placed on the floor.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A container for holding a toilet bowl plunger having a plunger head having a top, and a rod handle, comprising:

a) a container body having a substantially flattened top surface and an open interior to receive the plunger head, an asymmetric lid portion having inclined side edges and a horizontal bottom edge; and an asymmetric body portion having abutting side edges to said inclined edges of said asymmetric lid portion and a horizontal bottom edge separated from the lid;

b) wherein said container having an opening formed therein to permit said rod handle to extend upwardly out of said container when said plunger is stored in said container.

2. The container of claim 1, further comprising a bottom portion and wherein said bottom portion includes a moisture containment dam for containing dripping fluid from the plunger head within said container.

3. The container of claim 1 wherein said container body further includes an evaporation slot to permit the evaporation of fluid from said container.

4. The container of claim 3 wherein the evaporation slot is formed between said asymmetric body portion and said asymmetric lid portion.

5. The container of claim 2 further comprising an evaporation ridge, formed in said bottom portion.

6. The container of claim 1 in which said asymmetric lid portion includes handle.

7. The container of claim 1 wherein the asymmetric lid portion includes an overhang portion for preventing the container from sliding off a toilet seat.

8. The container of claim 2, wherein a bottom portion of the body portion comprises a recessed planar bottom surface.

9. The container of claim 1 wherein the opening in said container forms a plunger handle guiding aperture comprising a substantially semicircular configuration in the lid portion.

10. The container of claim 9 wherein the plunger handle guiding aperture includes a pair of contact rails, wherein when said container is closed about a plunger, said contact rails contact the top of said plunger head.

11. The container of claim 10 wherein said pair of contact rails further include a pair of contact tips, said contact tips being in contact with the top of said plunger head of said plunger when said container is in an open position, and further, wherein said contact tips act as a pivot for said body and said lid when said container is lowered over a toilet for opening and when said container is lifted from a toilet seat.

12. The container of claim 1, wherein the flattened top surface of the body portion includes an arcuate concave plunger guiding surface.

13. The container of claim 1, wherein the top surfaces of the asymmetrical lid portion and the body portion abut during a plunging operation.

14. A container for holding a toilet bowl plunger having a plunger head having a top, and a rod handle, comprising:

a) a container body comprising a substantially conical top surface, having an asymmetric lid portion having inclined side edges and a horizontal bottom edge, and an asymmetric body portion having abutting side edges to said inclined edges of said lid portion and a horizontal bottom edge separated from the lid, wherein the asymmetric body portion has a first portion of a plunger handle guiding aperture centered therein;

b) said asymmetrical lid portion including a top portion having a pair of hinges attached thereto, and a second portion of a plunger handle guiding aperture centered in the asymmetrical lid and being positioned between the hinges, and further being in alignment with the first portion of a plunger handle guiding aperture in said body portion; and c) whereby when the plunger is installed in said container, said rod handle extends upward through said first and second plunger handle guiding apertures.

15. The container of claim 14, further comprising a bottom portion and wherein said bottom portion includes a moisture containment dam for containing dripping fluid from the plunger head within said container.

16. The container of claim 14 wherein said container body further includes an evaporation slot to permit the evaporation of fluid from said container.

17. The container of claim 16 wherein the evaporation slot is formed between said asymmetric body portion and said asymmetric lid portion.

18. The container of claim 15 further comprising an evaporation ridge, formed in said bottom portion.

19. The container of claim 15, wherein a bottom portion of the body portion comprises a recessed planar bottom surface.

20. The container of claim 14, wherein the second portion of the plunger handle guiding aperture comprises a substantially semicircular configuration in the asymmetrical lid portion.

21. The container of claim 14, wherein the portion of the first plunger handle guiding aperture comprises a substantially circular configuration in the conical top surface.

22. The container of claim 14,wherein the conical top surface of the body portion includes an arcuate concave plunger guiding surface.

23. The container of claim 14, wherein the upper portion of the container body has a pair of support braces formed therein.

24. The container of claim 20 wherein the second portion of the plunger handle guiding aperture includes a pair of contact rails, wherein when said container is closed about a plunger, said contact rails contact said the top of said plunger head.

25. The container of claim 24 wherein said pair of contact rails further include a pair of contact tips, said contact tips being in contact with the top of said plunger head of said plunger, and further wherein said contact tips act as a pivot for said body and said lid when said container is lowered over a toilet for opening and when said container is lifted from a toilet seat.

* * * * *